US005730404A

United States Patent [19]

Evans et al.

[11] Patent Number: 5,730,404

[45] Date of Patent: Mar. 24, 1998

[54] GOLF CLUB HOLDER

[75] Inventors: Daniel J. Evans, 6609 Farmington La., Crestwood, Ky. 40014; Lawrence A. Brown, Louisville, Ky.

[73] Assignee: Daniel J. Evans, Crestwood, Ky.

[21] Appl. No.: 688,730

[22] Filed: Jul. 31, 1996

Related U.S. Application Data

[60] Provisional application No. 60/002,751 Aug. 24, 1995, and provisional application No. 60/008,709 Dec. 15, 1995.

[51] Int. Cl.[6] ..... A63B 55/10

[52] U.S. Cl. ..... 248/156; 473/282

[58] Field of Search ..... 473/282, 286, 473/408; 248/511, 530, 76, 87, 156; 172/372; 211/70.2

[56] References Cited

U.S. PATENT DOCUMENTS

| | | | |
|---|---|---|---|
| D. 221,279 | 7/1971 | Erickson . | |
| 2,024,484 | 12/1935 | Smith | 473/282 |
| 3,441,239 | 4/1969 | Frost | 248/156 |
| 3,870,300 | 3/1975 | Amendola . | |
| 4,007,928 | 2/1977 | Doubt . | |
| 4,063,731 | 12/1977 | Kitay . | |
| 4,627,621 | 12/1986 | Tate . | |
| 4,832,338 | 5/1989 | Magazzi . | |
| 5,116,046 | 5/1992 | Pace . | |
| 5,149,087 | 9/1992 | Thompson, Jr. . | |
| 5,226,647 | 7/1993 | Notarmuzi . | |
| 5,377,977 | 1/1995 | MacNeary | 473/286 |
| 5,401,019 | 3/1995 | Wissman et al. . | |
| 5,437,449 | 8/1995 | Zink | 473/286 |
| 5,492,230 | 2/1996 | Hurton | 473/282 |

*Primary Examiner*—Sebastiano Passaniti
*Assistant Examiner*—Stephen L. Blau
*Attorney, Agent, or Firm*—Wheat, Camoriano, Smith & Beres, PLC

[57] ABSTRACT

A golf club holder can be folded up to be carried in a golfer's pocket and can then be unfolded or extended so that its ground-piercing legs can be pushed into the ground. The golf club holder includes a clamp, having first and second clamping surfaces, at least one of which is movable relative to the other for clamping the golf club onto the golf club holder. The golf club holder is clamped onto the club and is then pushed into the ground simply by holding the grip of the club and pushing the club down until the head of the club rests on the ground. To remove the holder, the golfer simply pulls the club by its grip, pulling the holder out of the ground, and then removes the holder from the club. In this way, the golfer can keep a spare club handy without its grip getting wet and without having to bend down to pick up a club from the ground.

12 Claims, 11 Drawing Sheets

10
9
11
12
13
14
16
18
22
37
38

124
132
138
128
122
130

122
111
109
124
134
140
113
112

134
132
124
113
112
138
126
128
109
122
130
116
140
112

110
122
114
116
140
113
112
111
124
136
112

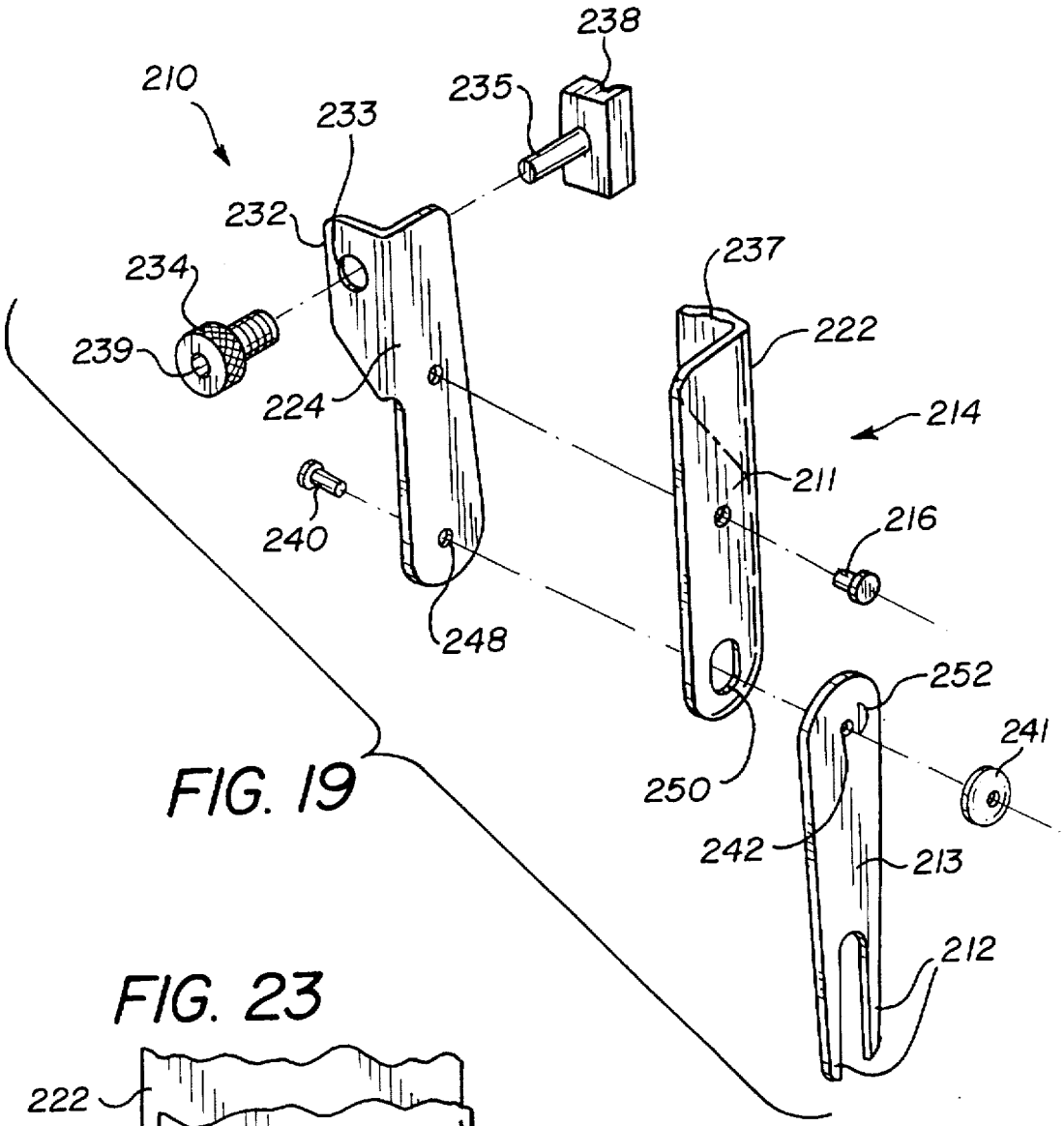
FIG. 19
FIG. 23
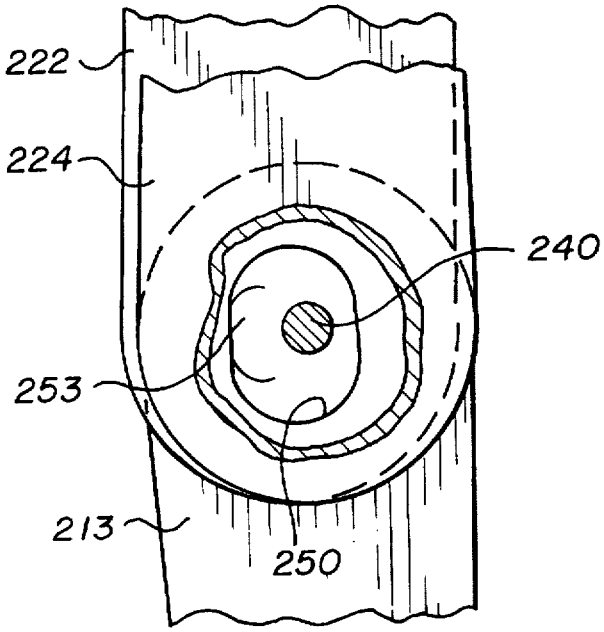

GOLF CLUB HOLDER

BACKGROUND OF THE INVENTION

This application claims priority from Provisional Applications Ser. No. 60,002,751, filed Aug. 24, 1995 and Ser. No. 60,008,709, filed Dec. 15, 1995. Golfers often carry more than one club at a time, and they typically lay the extra clubs down on the ground. This can be a problem, if the grass is wet, because it gets the grips of the clubs wet. It also can be a problem for golfers who have difficulty bending down to pick up the clubs.

SUMMARY OF THE INVENTION

The present invention provides a tool which can easily be carried in the golfer's pocket and which can be used to stand the extra club or clubs upright. Using this tool, the golfer can stand the club up and remove the club from the stand without ever bending over.

BRIEF DESCRIPTION OF THE DRAWINGS

FIG. 19 is an exploded perspective view of the golf club holder of FIG. 18;

FIG. 23 is a view taken along the section 23-23 of FIG. 21, with one of the arms partially broken away;

DESCRIPTION OF THE PREFERRED EMBODIMENTS

First embodiment

Figure 1:
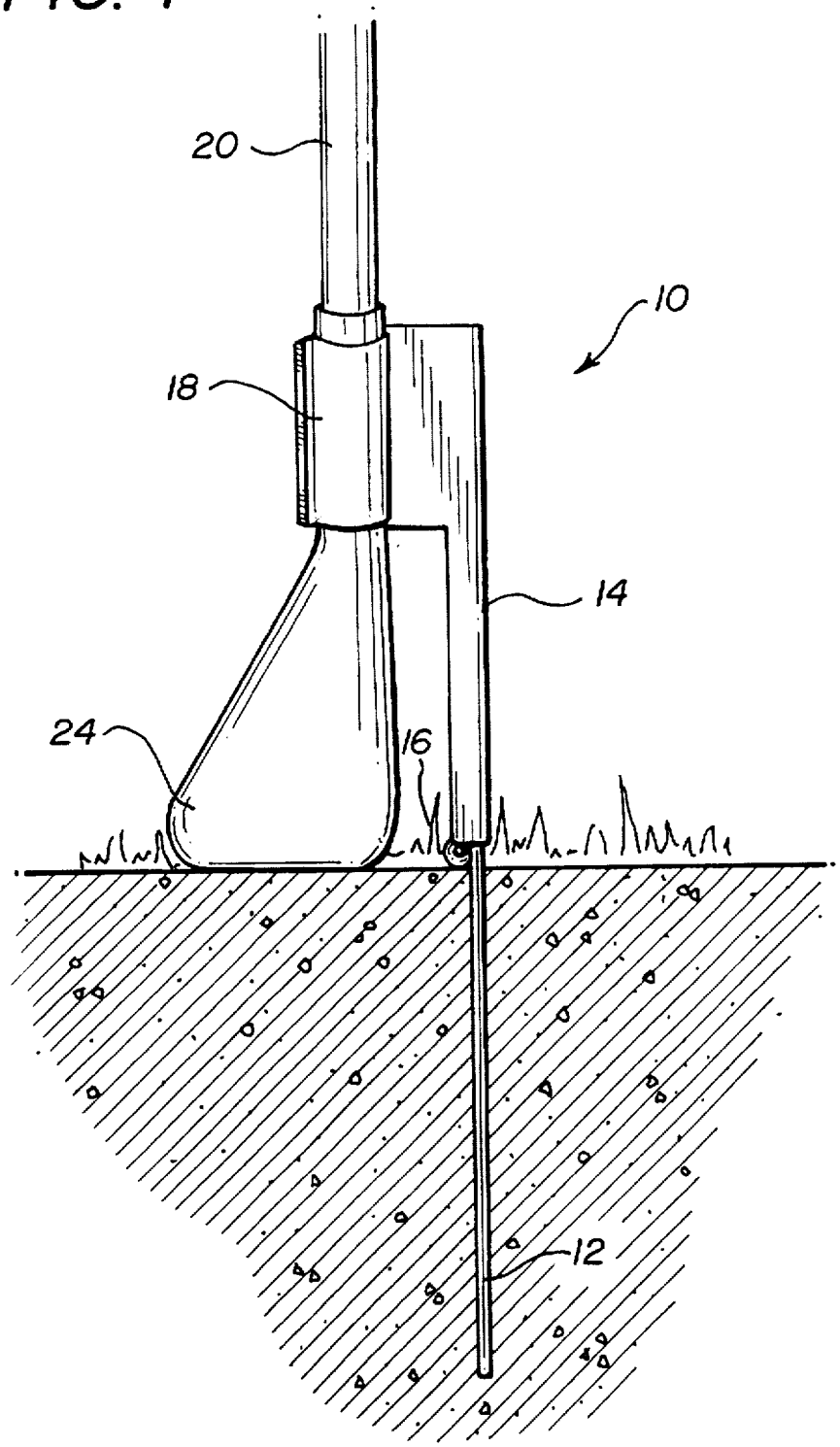
FIG. 1 is a side view of a preferred embodiment of the golf club holder of the present invention being used to hold a club upright.

FIGS. 1–6 show an embodiment of a golf club holder 10. The golf club holder 10 includes downwardly-projecting legs 12, which are connected together by a web 13. The legs 12 are tapered to a point so they can readily be pushed down into the ground. The body 14 of the golf club holder 10 has a front surface 9 and a rear surface 11, and is hinged to the web 13 by a hinge 16, so that the holder 10 can be pivoted to an extended position and then back to a retracted position. The hinge 16 defines a pivot axis that is parallel to a plane defined by the surface 11 of the body 14. The hinge 16 is preferably made with a tight fit, so that, once it is open, it requires a substantial amount of force to close it.

Mounted on the body 14 of the golf club holder 10 is a spring clip 18. The details of the spring clip 18 are shown best in FIGS. 4 and 6. The spring clip 18 has left and right clamp surfaces 37, 38 and is sized to clamp onto a golf club 20, as shown in FIG. 1. The spring clip 18 includes two springs 22, which provide force that helps keep the left and right clamping surfaces 37, 38 clamped onto the golf club 20 and which allow the clip 18 to flex open in order to remove the golf club holder 10 from the golf club 20.

Figures 2, 3, 4, 5, 6:
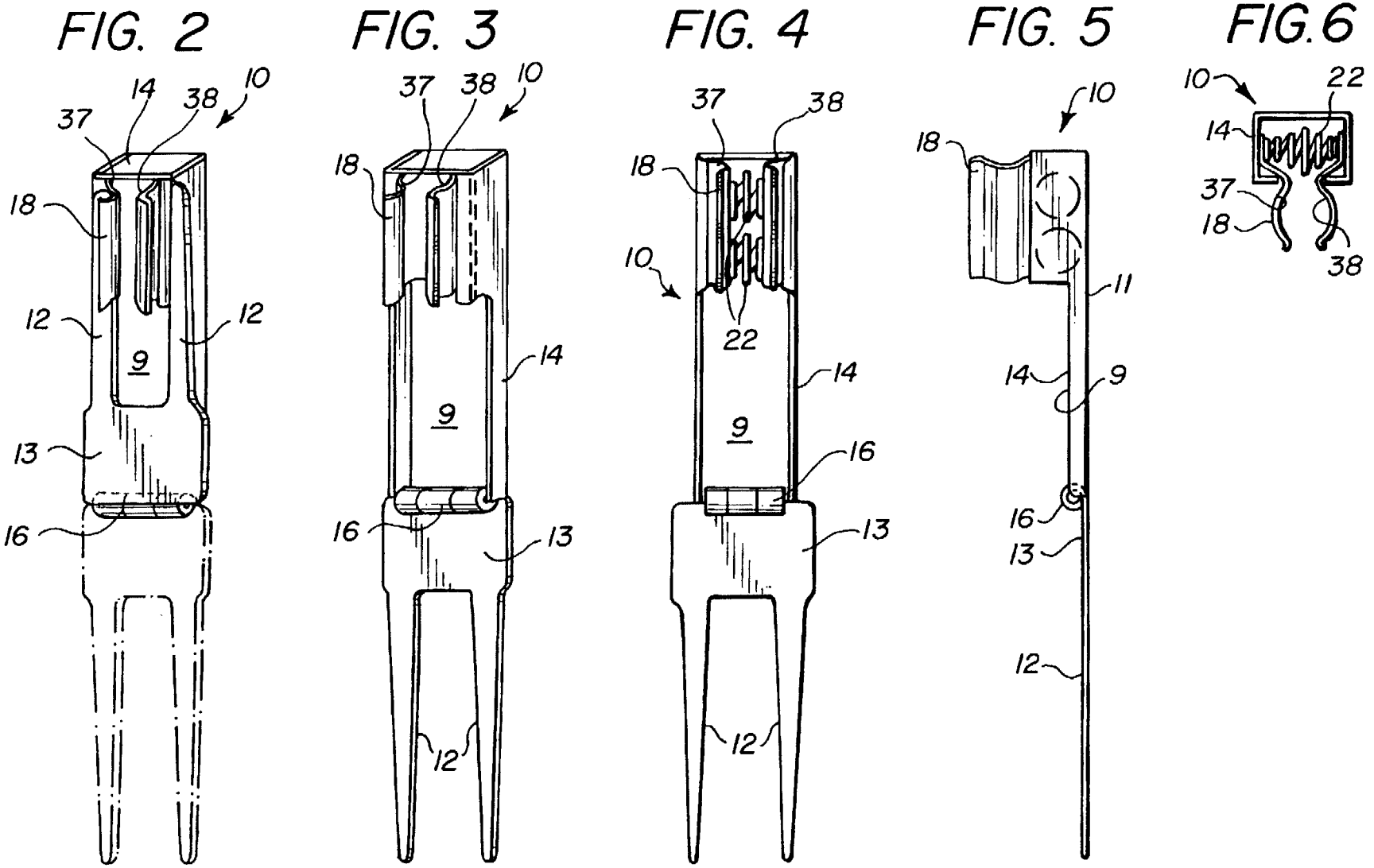
FIG. 2 is a front perspective view of the golf club holder of FIG. 1 when it is folded shut.
FIG. 3 is a front perspective view of the golf club holder of FIG. 1 in the open position.
FIG. 4 is a front view of the golf club holder of FIG. 1.
FIG. 5 is a side view of the golf club holder of FIG. 1.
FIG. 6 is a top view of the golf club holder of FIG. 1.
Figure 7:
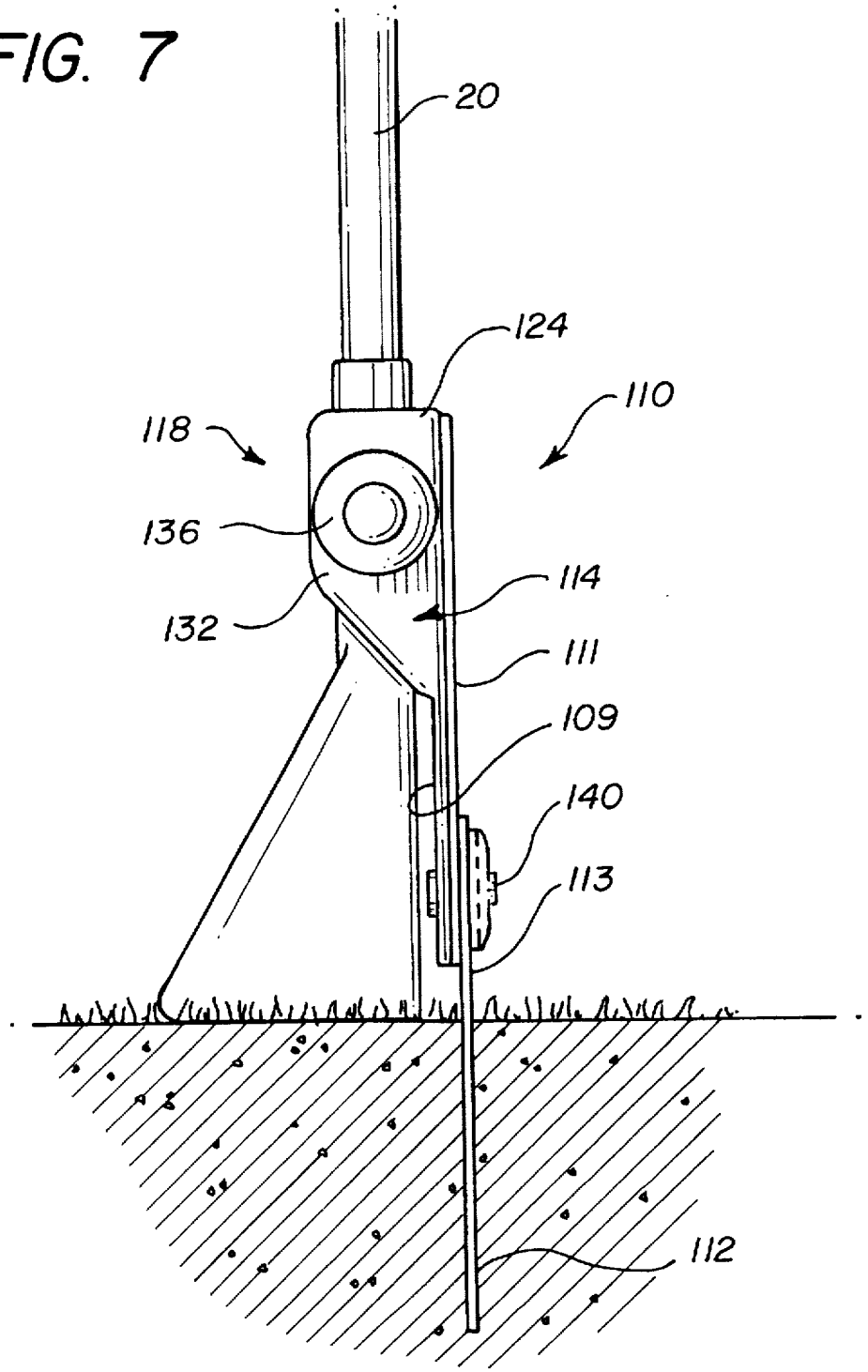
FIG. 7 is a side view of a second embodiment of a golf club holder made in accordance with the present invention being used to hold a golf club upright in the ground.
Figure 8:
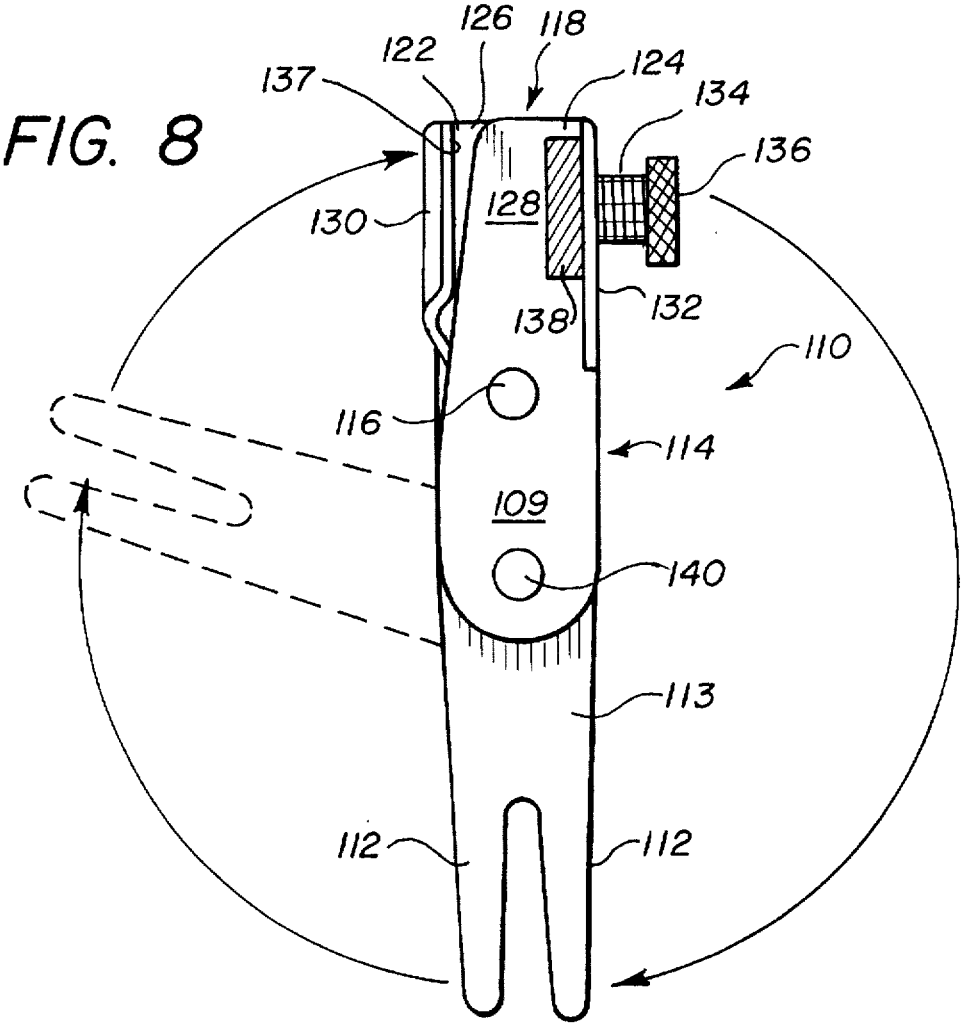
FIG. 8 is a front view of the golf club holder of FIG. 7, showing the forked leg portion in phantom in a second position.
Figure 9:
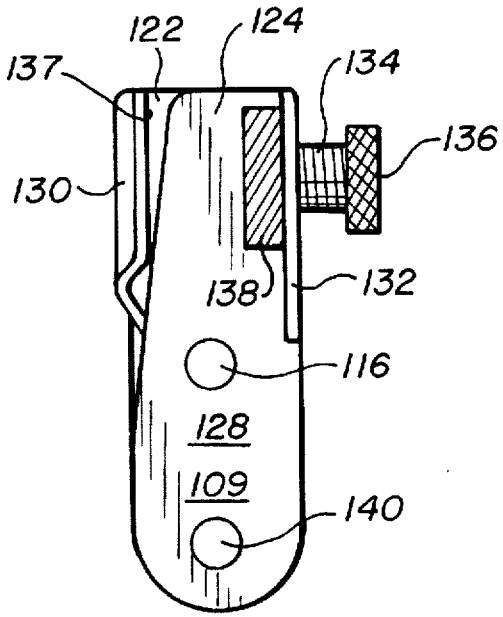
FIG. 9 is a front view of the golf club holder of FIG. 7, when it is folded up for carrying.
Figures 10, 11, 12, 13:
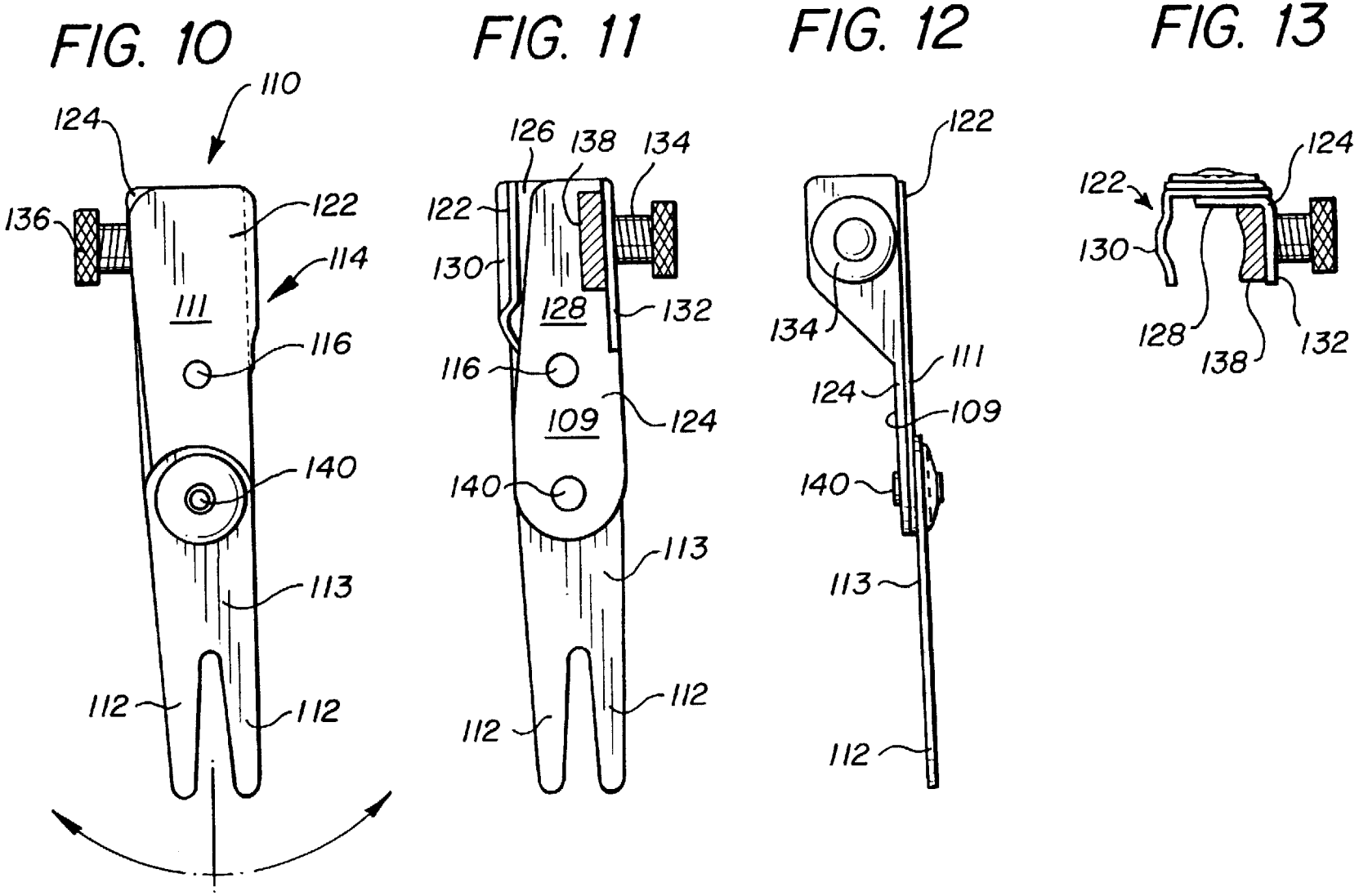
FIG. 10 is a rear view of the golf club holder of FIG.
FIG. 11 is a front view of the golf club holder of FIG. 7, when it is in its fully extended position.
FIG. 12 is a side view of the golf club holder of FIG. 7 in the extended position.
FIG. 13 is a top view of the golf club holder of FIG. 7.
Figure 15:
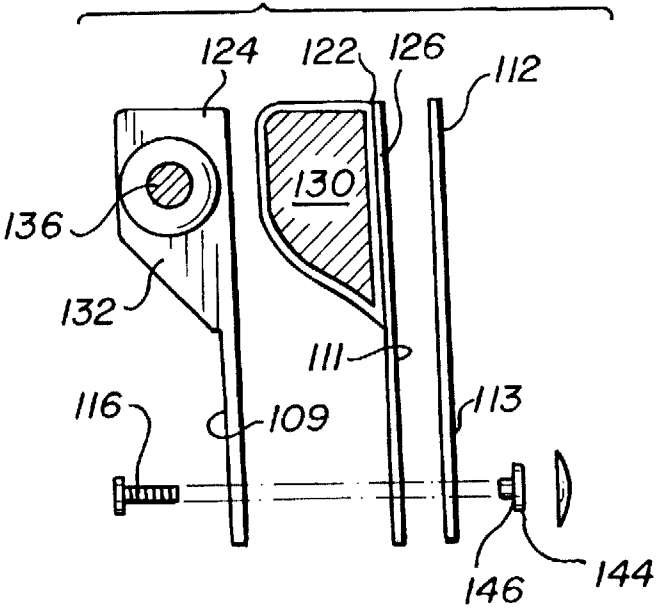
FIG. 15 is an exploded right side view of the golf club holder of FIG. 7.

The golf club holder 10 can be folded up as shown in FIG. 2, with the legs 12 straddling the clip 18, so the holder 10 can be carried in the golfer's pocket. When the golfer wants to use the golf club holder 10, the holder is removed from the pocket, the legs 12 are extended as shown in FIG. 3, and the spring clip 18 is clipped onto the golf club 20. Then, the golfer holds the grip (not shown) of the golf club so the club is in a vertical position, and pushes the legs 12 down into the ground until the head 24 of the club 20 rests on the ground. To remove the club 20, the golfer holds the grip (not shown) of the club 20 and pulls the club 20 straight up, until the legs 12 are lifted out of the ground. Then the golfer removes the holder 10 from the club 20, and uses the club 20.

The legs 12 of the golf club holder 10 can also be used to repair divots, in a manner that is well-known to golfers.

Second embodiment

Referring now to FIGS. 7–17, a second embodiment is shown. In this embodiment, the golf club holder 110 includes ground-piercing legs 112 connected together by a web 113. The main body 114 of the golf club holder has a front 109 and a rear surface 111, and includes a clamp 118, which grips the club 20. The clamp 118 includes a left clamping surface 137 and a right clamping surface 138, and the right clamping surface 138 is moved toward the left clamping surface in order to grip the shaft of the golf club 20. The leg portion of the holder (the legs 112 and web 113) is pivotably mounted to the main body 114 by the pin 140. The pin 140 defines a pivot axis that is perpendicular to a plane defined by the rear surface 111 of the body 114.

The main body 114 includes several parts. There is a left arm 122 and a right arm 124. Both the left and right arms 122, 124 have a flat back portion 126, 128 and a side portion 130, 132, which is substantially perpendicular to the respective back portion. The legs 112 and web 113 lie on a plane that is parallel and adjacent to the plane of the back 126 of the left arm 122, which, in turn, is parallel and adjacent to the plane of the back 128 of the right arm 124. The pivot pin 140 extends through all three members—the web 113, the back 128 of the right arm, and the back 126 of the left arm. The side 130 of the left arm 122 is slightly curved in order to help it wrap around the golf club. The side 132 of the right arm 124 has a threaded hole (not shown), which receives a screw 134. On the outer end 5 of the screw 134 is a head 136, and, on the inner end of the screw 134 is the right clamp surface 138. The golf club 20 is clamped between the left clamping surface 137 on the inside of the left side 130 of the left arm 122 and the right clamping surface 138 of the screw 134. The screw 134 can be adjusted in or out to compensate for different sizes of clubs simply by turning the head 136 manually.

There is a second mechanism which increases the clamping force after the screw 134 has been hand tightened. This mechanism operates in such a manner that, when the legs 112 are pivoted out from the folded or retracted position of FIG. 9 to the extended position of FIG. 11, they cause the left and right arms 122, 124 to pivot relative to each other about the pivot point 116, clamping the sides 130, 132, and their respective clamping surfaces 137, 138, together more tightly.

Figure 14:
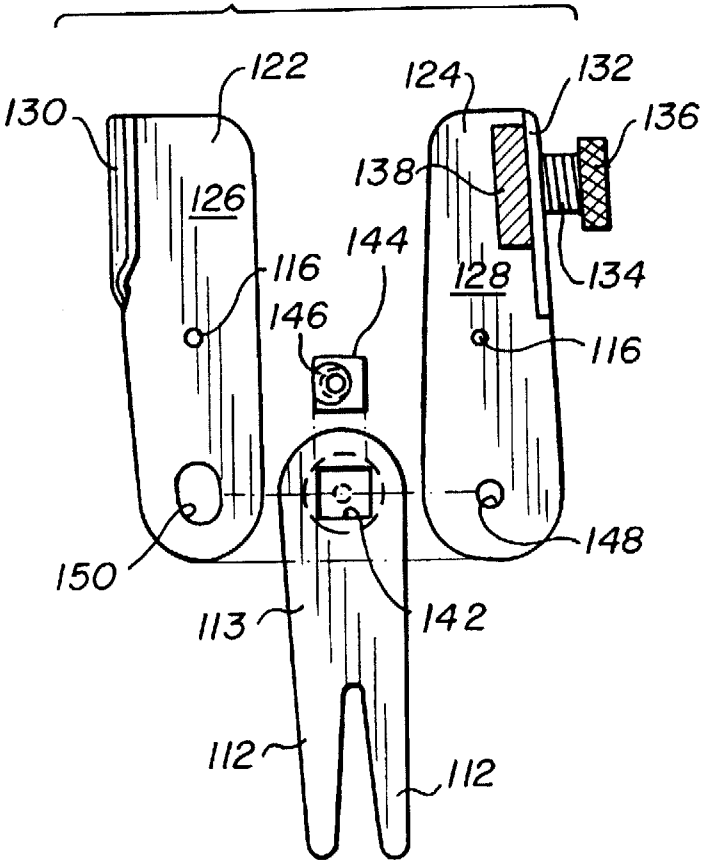
FIG. 14 is an exploded front view of the golf club holder of FIG. 7.
Figure 16A:
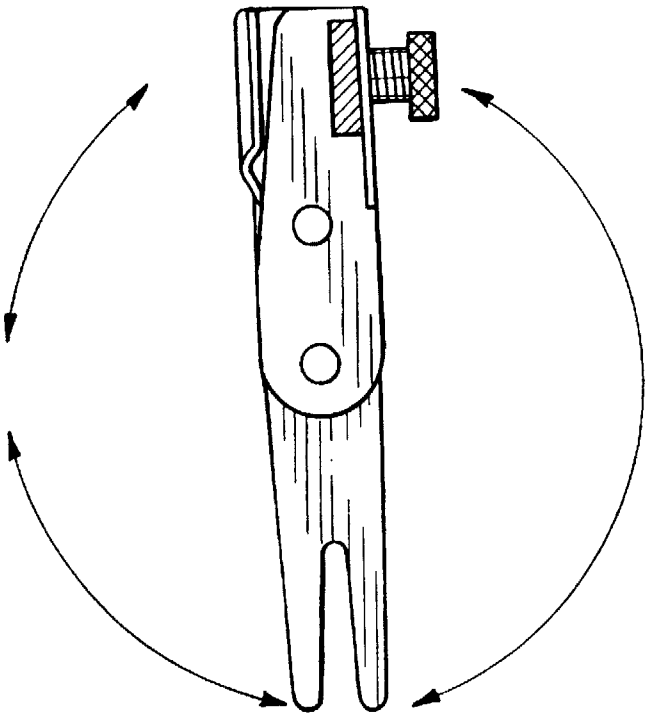
FIG. 16A is a front view o the club holder of FIG. 7
Figure 17:
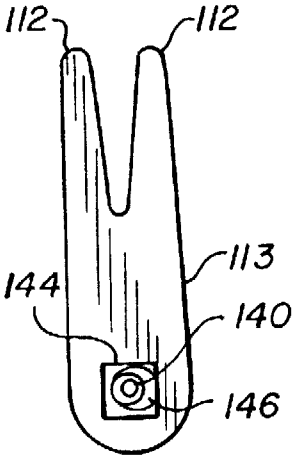
FIG. 17 is a front view showing the location of the cam when the legs are up.
Figure 16:
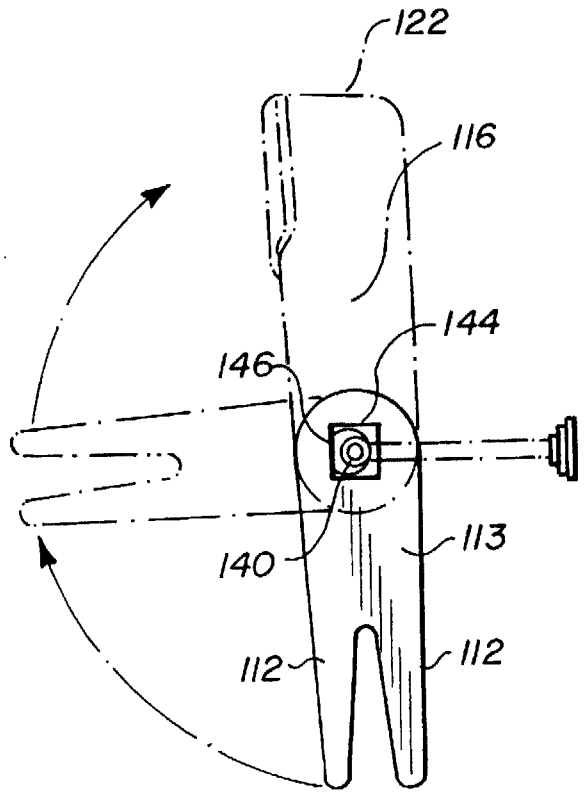
FIG. 16 is a front view showing the location of the cam when the legs are down.

FIGS. 14–17 show this second mechanism in more detail. As shown in FIG. 14, there is a square hole 142 in the web 113 at the point where the pin 140 goes through the web 113. This square hole 142 receives a cam insert 144, which has a square outside dimension to fit into the square hole, and which has a cam 146, which projects out into an elongated hole 150 in the left arm. The cam insert 144 is inserted into the web 113 in the position shown in FIG. 14, so that, when the legs 112 are in the extended position, the enlarged side of the cam is to the left, and, when the legs 112 are rotated 180 degrees to fold up the golf club holder, the enlarged side of the cam is to the right, as shown in FIG. 17.

The right arm 124 of the holder 110 has a small hole 148 which is just large enough to receive the pin 140. The pin 140 extends through the small hole 148 in the right arm, through the large hole 150 in the left arm 122, and through the cam 146 in the cam insert 144, which is in the web 113. The left and right arms 122, 124 are pinned together at the point 116, so they can pivot relative to each other about that point 116, with the cam 146 pushing them together and apart on the other end. When the legs 112 are folded up, and the enlarged side of the cam is to the right, as in FIG. 17, the bottom of the left arm is moved to the right, causing the tops of the left and right arms to be pivoted slightly apart. Then, when the legs 112 are pivoted down, as in FIG. 16, the cam moves the bottom of the left arm to the left, causing the top of the left arm 122 to pivot to the right about the point 116, toward the right arm 124, tightening the clamp.

Thus, the intended use of the golf club holder 110 is as follows. The golfer carries the holder 110 in the folded up position and clamps it onto the golf club in the folded up or retracted position. Then, before sticking the legs 112 of the holder 110 into the ground, the golfer pivots the legs 112 out into the extended position, thereby clamping the holder 110 more tightly onto the club 20. To pull the holder 110 out of the ground, the golfer simply grabs the club 20 by the grip and pulls the club up, pulling the holder 110 out of the ground. Then, when removing the holder from the club, the golfer first pivots the legs 112 into the retracted position, loosening the clamp, and then manually unscrews the clamp as needed in order to remove it from the club.

Third embodiment

FIGS. 18–24C show a third embodiment of a golf club holder 210 made in accordance with the present invention, which is the embodiment the inventor plans to manufacture. This golf club holder 210 is very similar to the second embodiment, described above. The holder 210 includes a main body 214, having a front surface 209 and a rear surface 211, said maid body being made up of left and right arms 222, 224, which lie adjacent and parallel to each other. The left arm 222 has a left clamping surface 237 at its upper end, and the right arm 224 has a right clamping surface 238 at its upper end, which is movable relative to the right arm and relative to the left clamping surface 237, for clamping the shaft of a golf club 20 between the left and right clamping surfaces 237,238. The left and right arms 222, 224 pivot relative to each other about a pivot pin or rivet 216.

At its lower end, the holder 210 also includes a leg portion, made up of two legs 212 interconnected by a web 213. The ground-piercing legs 212 are pointed at the end to facilitate pushing them into the ground. The leg portion pivots relative to the body portion 214 of the holder 210 about the pin 240 to move from a retracted position to an extended position, and, as it moves to the extended position, it moves the left and right clamping surfaces 237, 238 a bit closer together, further tightening the grip on the club, in a manner similar to that described with respect to the second embodiment.

Figure 18:
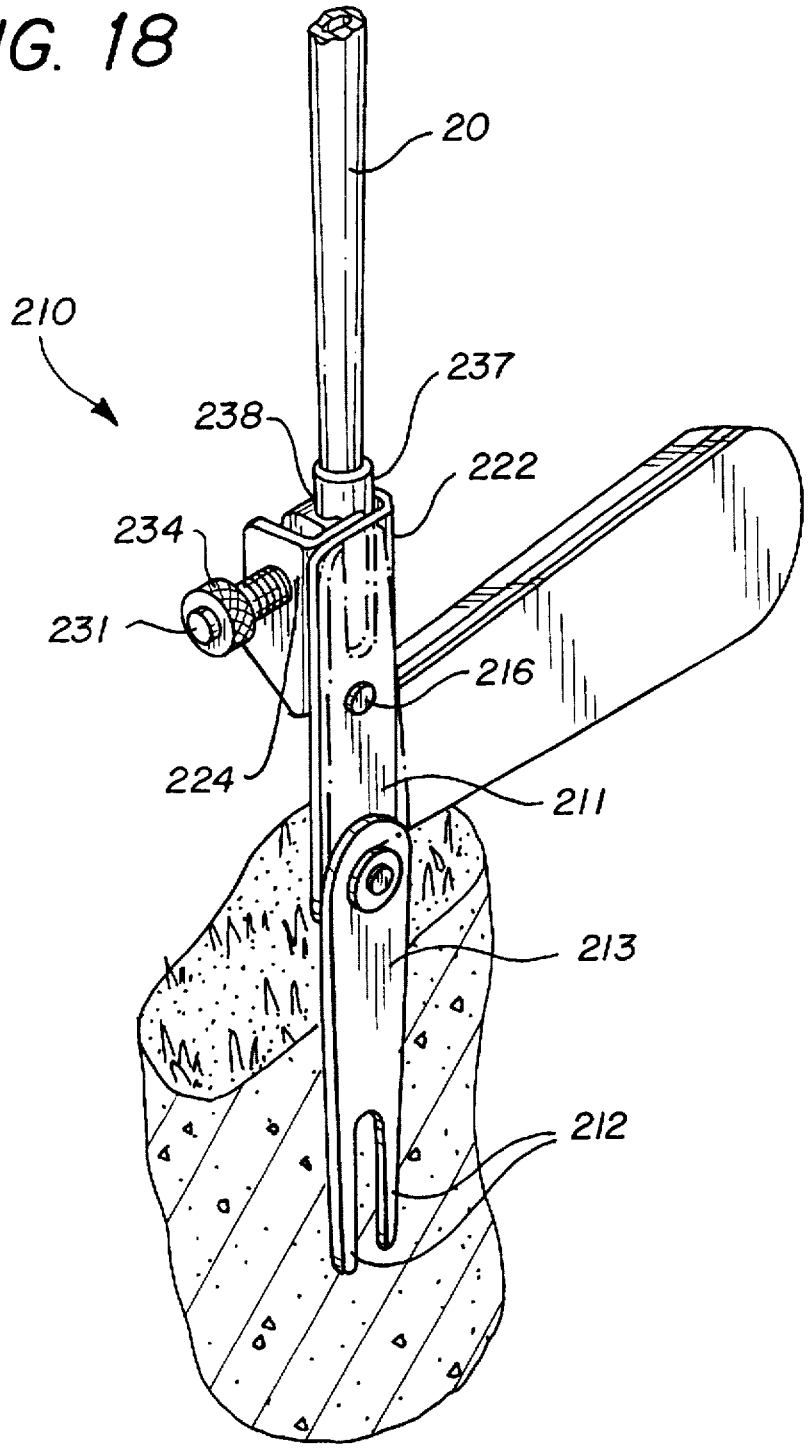
FIG. 18 is a perspective view of a third preferred embodiment of a golf club holder made in accordance with the present invention, showing the golf club holder pushed into the ground and holding a golf club.

Looking at FIG. 18, it can be seen that, when the club 20 is held upright by the holder 210, the legs 212 are in the ground, and the head 24 of the club rests on the ground, providing a stable support for the club 20. Also, since the club 20 is held substantially vertically by the holder 210, there is not much side-to-side force for the holder to support. This is true not only for this embodiment but for all three embodiments described herein.

Figure 22:
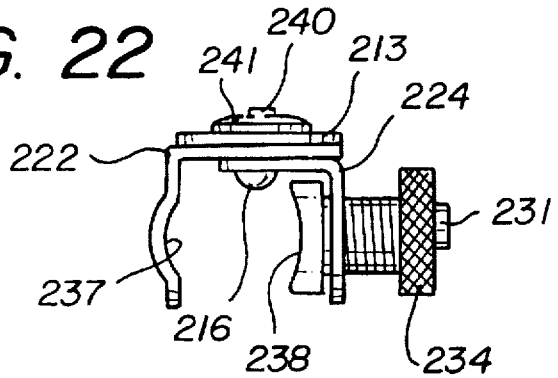
FIG. 22 is a top view of the golf club holder of FIG. 20.
Figure 20:
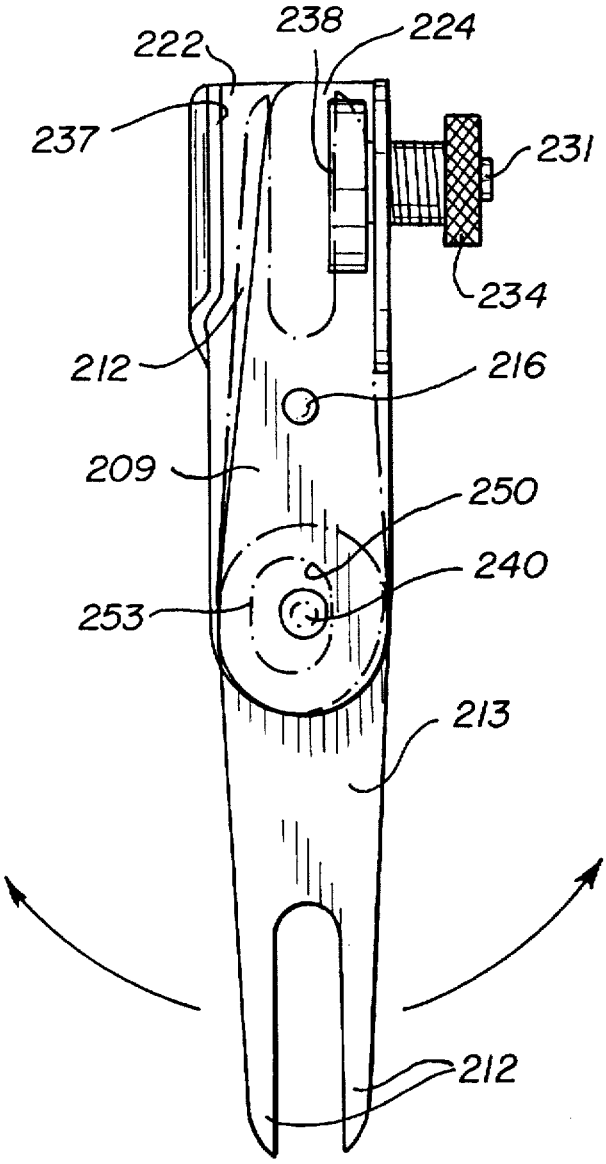
FIG. 20 is a front view of the golf club holder of FIG. 18 in the extended position.
Figure 21:
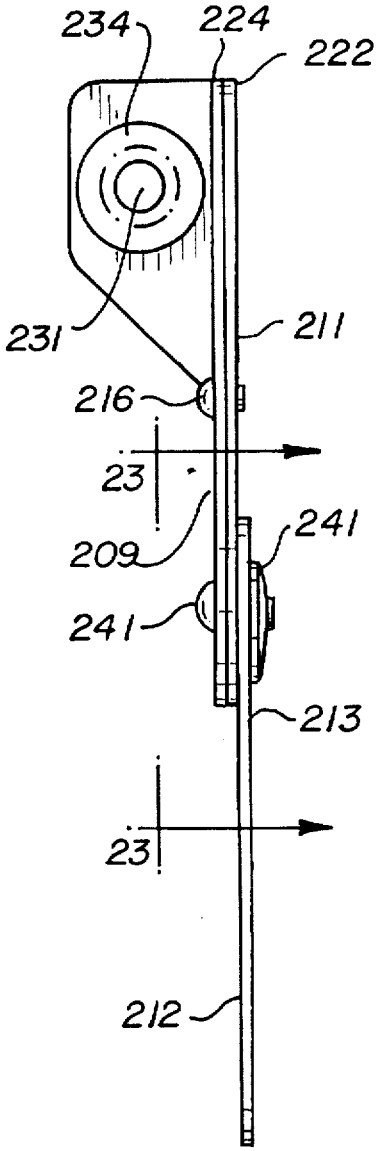
FIG. 21 is a side view of the golf club holder of FIG. 20.

Referring now to FIG. 19, there is shown an exploded perspective view of the holder 210. There is a thumb screw 234 which threads into a threaded hole 233 in the side 232 of the right arm 224, and the right clamping surface 238 is mounted on the thumb screw 234 by means of a leg 235 which extends through an axial hole 239 in the thumb screw 234 and is then upset or deformed on the other side 231 (as shown in FIGS. 18 and 22) to prevent it from coming back out of the hole 239. Similarly, the central rivet 216 is riveted after it has passed through the holes in the arms 222, 224 to keep it in place.

At the lower ends of the arms 222, 224 are holes 248, 250, which receive a second pin 240. The second pin 240 also extends through a small hole 242 in the web 213 of the leg portion and allows the leg portion to pivot relative to the body portion 214 of the holder 210 about the pin 240. The second pin 240 also extends through a spring washer 241 and is deformed or riveted on the back side of the washer 241 to hold the pin 240 in place and keep the two arms 222, 224 and the leg portion held tightly together.

FIG. 19 also shows an indentation 252 on the back surface of the leg portion near the hole 242. This indentation 252 lies opposite an embossed projection 253 on the opposite surface of the leg portion, as shown in FIG. 23. This projection 253 performs essentially the same function that was performed by the cam surface in the previous embodiment, which is both to move the clamping surfaces 237, 238 together slightly when the legs 212 are extended and to lock the legs in the extended position, providing enough friction to prevent the legs 212 from collapsing to the retracted position when the holder 210 is holding a golf club 20 upright on the ground. Both the left and right clamping surfaces 237, 238 are curved to provide better contact with the shaft of the golf club 20.

Figure 24C:
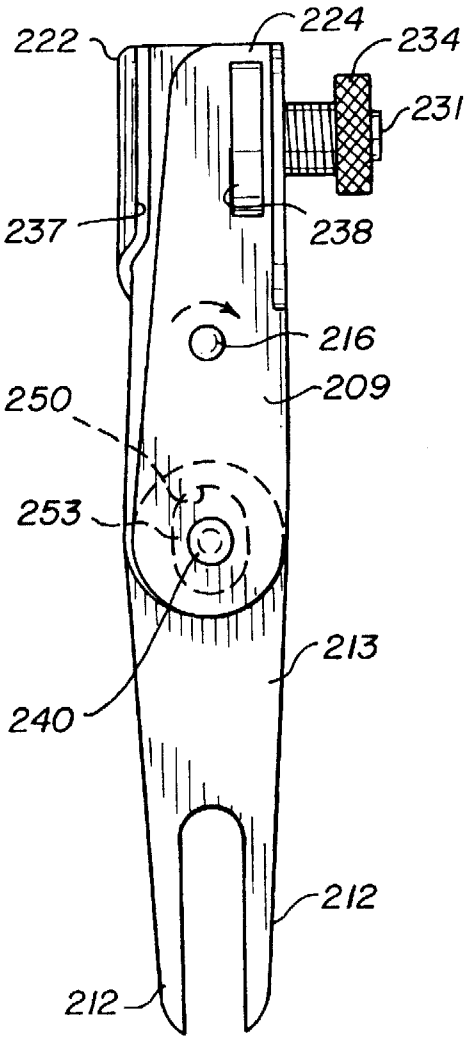
FIG. 24C is a front view of the golf club holder of FIG. 18 in the extended position.
Figure 24B:
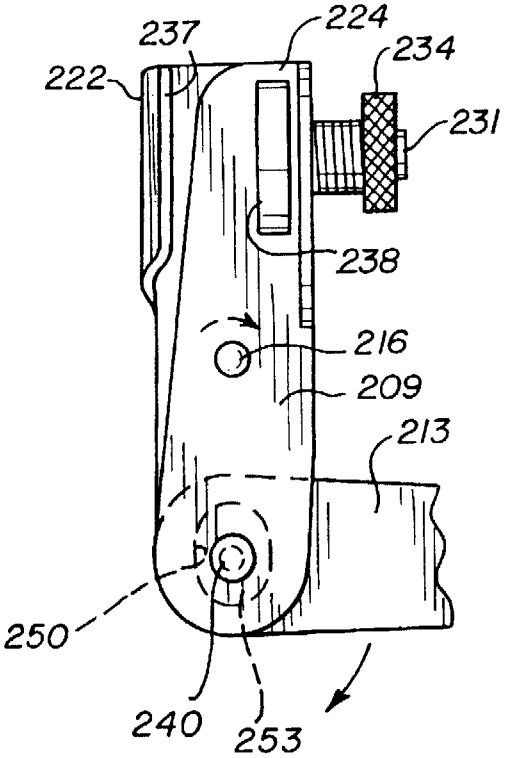
FIG. 24B is a front view of the golf club holder of FIG. 18 as it is being moved to the extended position.
Figure 24A:
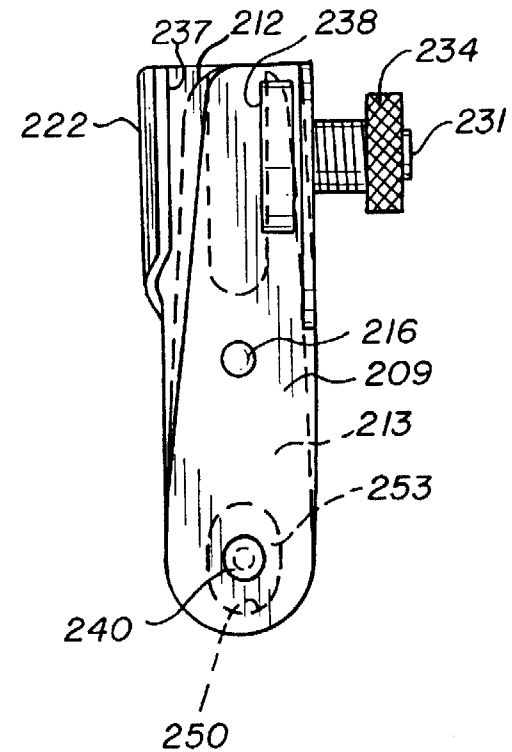
FIG. 24A is a front view of the golf club holder of FIG. 18 in the retracted position.

FIGS. 24A–C show how the left and right clamping surfaces 237, 238 move together as the legs 212 pivot down, to their extended position. In FIG. 24A, the legs 212 are retracted, and the projection 253 on the web 213 is pressing against the right side of the elongated, oval hole 250 in the bottom portion of the left arm 222. This causes the left arm 222 to shift slightly to the right below the central pivot 216, which causes the top of the left arm 222 to shift to the left, opening the space between the left and right clamping surfaces 237, 238. It is in this position that the holder 210 should be clamped onto the golf club 20 by tightening the thumb screw 234.

When the legs 212 are pivoted downwardly, either to the right, as shown in FIG. 24B or to the left (not shown), the projection 253 moves to an elongated portion of the oval hole 250. Then, when the legs 212 are fully extended to a position which is approximately 180 degrees from the retracted position, as shown in FIG. 24C, the projection or cam 253 bears against the left side of the elongated hole 250 in the left arm 222, causing the bottom of the left arm 222 to move to the left, which causes the top of the left arm 222 to pivot to the right about the pin 216, reducing the space between the left and right clamping surfaces 237, 238 as shown by the arrows. The projection or cam surface 253 bearing against the left arm 222 also provides a frictional force which tends to keep the holder 210 in the extended position, so it does not collapse when it is holding a golf club upright on the ground.

While the description above refers to left and right sides, it is clear that deliniating left and right is simply a matter of convenience, and the left and right could be reversed by making the golf club holder as a mirror image of the holders described above or simply by changing which side is referred to as left or right. It will be obvious to those skilled in the art that modifications may be made to the embodiments described above without departing from the scope of the present invention.

What is claimed is:

1. A tool for holding a golf club which has a head and a shaft, comprising:

a body, having a front surface and a rear surface, and including a clamp, having first and second clamping surfaces, said second clamping surface being movable toward and away from said first clamping surface, wherein, when said second clamping surface is moved toward said first clamping surface, the shaft of a golf club can be clamped between said first and second clamping surfaces; and a ground-piercing leg pivotably connected to said body, said leg being pivotably to a retracted position, in which it lies adjacent to said body, thereby reducing the overall length of said tool to the length of said body, and to an extended position, which is approximately 180 degrees from said retracted position, and wherein, when said ground-piercing leg is inserted into the ground and said clamp is clamped onto the shaft of a golf club, the golf club is held substantially vertically.

2. A tool for holding a golf club as recited in claim 1, wherein said tool includes two of said ground-piercing legs; and a web connecting said ground-piercing legs together; said web defining a first hole; said body defining a second hole; said first and second holes being aligned; and a pin extending through said first and second holes to form the pivot connection between said ground-piercing legs and said body.

3. A tool for holding a golf club as recited in claim 2, wherein said body includes a left arm and a right arm; said left arm including said first clamping surface and said right arm including said second clamping surface, wherein said left arm is pivotable relative to said right arm.

4. A tool for holding a golf club as recited in claim 3, wherein said second clamping surface is threaded onto and movable relative to said right arm.

5. A tool for holding a golf club as recited in claim 4, wherein one of said left and right arms defines said second hole, and the other of said left and right arms defines a larger, elongated hole; and further comprising a cam surface which pushes against said elongated hole when said legs are in the extended position.

6. A tool for holding a golf club as recited in claim 2, wherein said pin defines a pivot axis that is perpendicular to a plane defined by said rear surface.

7. A tool for holding a golf club as recited in claim 2, wherein said pin defines a pivot axis that is within or parallel to a plane defined by said rear surface.

8. A tool for holding a golf club as recited in claim 11, and further comprising a golf club having a shaft and a head, said golf club being mounted on said golf club holder, with the head directed downwardly and the shaft clamped between the first and second clamping surfaces.

9. A tool for holding a golf club as recited in claim 1, wherein said leg lies adjacent to one of said front and rear surfaces of said body when said tool is in said retracted position.

10. A tool for holding a golf club, comprising:

a body, including first and second arms, said first and second arms being approximately the same length and having a top portion, a central portion, and a lower portion;

first and second clamping surfaces on the top portions of said first and second arms, respectively, for clamping the shaft of a golf club between said first and second clamping surfaces;

a first pivot pin extending through the central portion of said first and second arms so that said arms pivot relative to each other about said first pivot pin;

a ground-piercing leg member pivotably mounted on the lower portion of said body at a lower pivot point; wherein said lower pivot point includes a small hole in said ground-piercing leg member, a small hole in the lower portion of one of said arms and a large, elongated hole in the lower portion of the other of said arms; and a second pin extending through said small holes and said elongated hole; and a cam surface which moves with the ground-piercing leg member and acts against the elongated hole, so that, as the ground-piercing leg member is pivoted to an extended position, the cam surface causes the arms to move away from each other at the lower pivot point, causing the arms to pivot relative to each other about the central pivot point, and bringing the clamping surfaces toward each other.

11. A tool for holding a golf club as recited in claim 10, wherein said cam surface is a projection from the ground-piercing leg member.

12. A tool for holding a golf club as recited in claim 11, wherein one of said first and second clamping surfaces is movably mounted on its respective arm by a threaded member which is threaded through a hole in its respective arm.

* * * * *